United States Patent [19]

Moloney

[11] Patent Number: 4,705,183

[45] Date of Patent: Nov. 10, 1987

[54] CORROSION RESISTANT CLOSURE CONSTRUCTION

[75] Inventor: John J. Moloney, Naperville, Ill.

[73] Assignee: Continental White Cap, Inc., Northbrook, Ill.

[21] Appl. No.: 900,765

[22] Filed: Aug. 27, 1986

[51] Int. Cl.[4] ..... B65D 41/04
[52] U.S. Cl. ..... 215/276
[58] Field of Search ..... 215/276, 274, 350

[56] References Cited

U.S. PATENT DOCUMENTS 3,307,728 3/1967 Elser ..... 215/276
3,933,267 1/1976 Rohde ..... 215/350

*Primary Examiner*—Donald F. Norton
*Attorney, Agent, or Firm*—Charles E. Brown

[57] ABSTRACT

A closure panel for a composite closure which is formed of a corrosive metal and while the metal of the closure panel is coated on both edges, in the formation thereof a raw edge develops. In lieu of a straight peripheral flange terminating in such raw edge, the peripheral flange has been modified to terminate in a curl with the raw edge being protected by the curl.

10 Claims, 4 Drawing Figures

CORROSION RESISTANT CLOSURE CONSTRUCTION

This invention relates in general to new and useful improvements in closures, and more particularly to improvements in the end panel of a composite closure.

In a typical composite closure employing a metal portion or panel, coatings are applied to the opposite side of the metal before the panel is punched in a press. The exposed cut edge, if not covered, can be susceptible to corrosion which includes rust, if the metal contains iron.

It is difficult and rather expensive to attempt to coat the raw edge of each relatively inexpensive end panel. On the other hand, the use of a non-corrosive metal, such as aluminum, is also rather expensive.

In accordance with this invention, it is proposed to terminate the edge of the closure panel in a curl which will effectively hide the raw edge and at the same time to minimize the contact of the cut edge with corrosive media.

The utilization of a curl as opposed to a rather jagged cut edge provides another desirable feature in that the curl presents a curved surface for engagement with the customary plastic fitment so that there may be relative rotation between the fitment and the metal panel. On the other hand, the cut edge may produce high resistance to such relative rotation.

In addition to the corrosion and rotation factors, another benefit of a curled panel can be the ease of manufacturing. An uncurled panel is difficult to convey and is susceptible to damage such as denting, whereas a curled panel is more rigid and lends itself to handling operations more readily.

Finally, a curled panel of a proper configuration may be more receptive of the customary gasket by spin lining.

With the above and other objects in view that will hereinafter appear, the nature of the invention will be more clearly understood by reference to the following detailed description, the appended claims, and the several views illustrated in the accompanying drawings.

Figure 1:
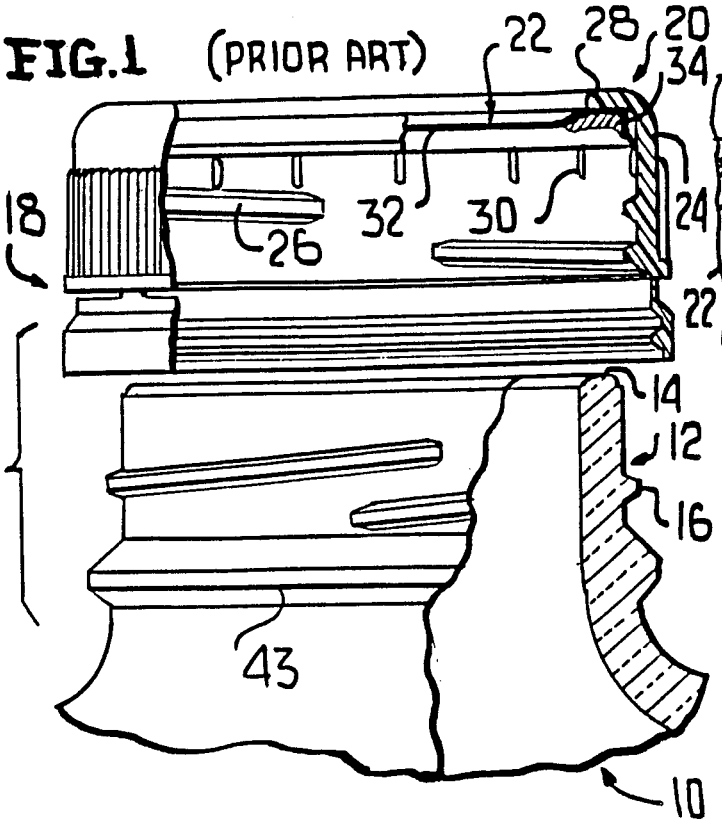
FIG.1 (PRIOR ART)
FIG. 1 is an exploded elevational view of a customary composite closure and the container to which it is applied.
Figure 2:
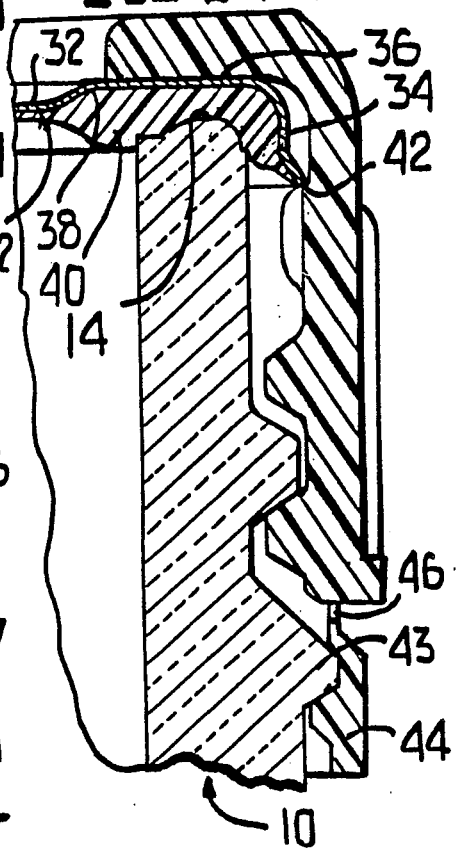
FIG.2 (PRIOR ART)
FIG. 2 is a fragmentary sectional view taken through the composite closure of FIG. 1 as applied to the container of that figure and shows specifically the details of the prior art.
Figure 3:
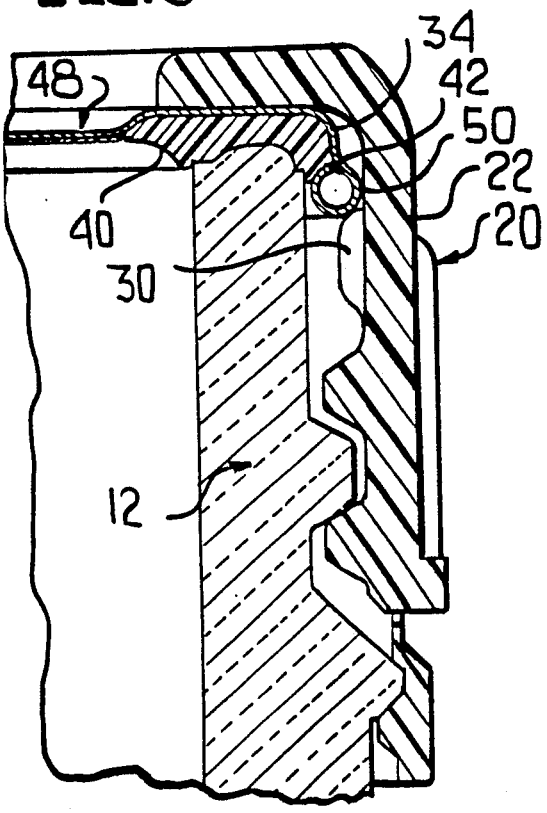
FIG. 3 is a sectional view similar to FIG. 2 and specifically shows one form of the invention.

Referring now to the drawings in detail, it will be seen that there is illustrated in FIGS. 1 and 2 a prior art composite closure and the neck finish of a container to which such closure is secured in sealed relation. The container for which the composite closure is generally intended is identified by the numeral 10 and includes a neck finish 12. The neck finish 12 terminates in an end sealing surface 14 and is provided with means for securing the closure in place, preferably external threads 16.

The composite closure is generally identified by the numeral 18 and includes a ring-like fitment, generally identified by the numeral 20 and a closure panel, generally identified by the numeral 22. The fitment 20 is preferably formed of a plastic material and includes a skirt or body portion 24 which is intended to telescope over the neck finish 12 and which is provided with suitable fastening means 26, illustrated as threads, for cooperation with the fastening means 16 of the neck finish 12. The skirt or body 24 terminates at its upper end in an inwardly directed annular flange 28. Further, above the fastening means 26 on the interior of the body or skirt 24 are lug means 30 whose function will be described in detail hereinafter.

The closure panel 22 is customarily formed of a ferrous metal and is coated on opposite sides thereof. The closure panel 22 includes a recessed central portion 32 and terminates in a peripheral generally cylindrical flange 34. Between the recessed central portion 32 and the flange 34, the closure panel 22 is upwardly offset as at 36 and defines a pocket 38 in which there is seated a suitable gasket 40.

The closure panel 22, being formed of coated metal, and being formed by a punching operation, results in the peripheral flange terminating in a raw edge 42. This raw edge is, of course, free of a coating material and since the closure panel 22 is formed of a ferrous metal, is subject to rusting. Further, since the punching operation is a shearing operation, the raw edge, when magnified, is somewhat jagged.

Recent attempts have been made to eliminate the raw edge 42 by coating the same. This, however, is an expensive operation as opposed to the general course of forming the closure panel 22. Further, the closure panel 22, as shown in FIGS. 1 and 2, has other deficiencies as discused hereinabove.

It is also to be understood for a completeness of description of the closure and the neck finish 12 that the neck finish 12 may include a lower radially outwardly projecting rib 43 below which a tamper indicating ring or band 44 may lock, the band or ring 44 being integrally connected to the lower edge of the body or skirt 24 by way of breakable connectors 46.

In accordance with this invention, additional metal is provided in the formation of a modified form of closure panel, generally identified by the numeral 48. The closure panel 48 is of the same construction as the closure panel 22 except that in lieu of the offset annular flange 36 extending into the corner between the annular flange 28 and the body or skirt 24 of the fitment 20, it terminates short with the result that the peripheral flange 34 is spaced from the inner surface of the body 22. Further, instead of the peripheral flange 34 being generally cylindrical, it terminates in a curl 50 in accordance with the invention. It is to be noted that the curl extends first radially outwardly and then radially inwardly so that the normal raw edge 42 terminates remote from the bottom or lower part of the closure panel 48 and is substantially hidden within the curl. Thus the curl 50 extends both externally and internally of the peripheral flange 34. Further, it will be seen that the raw edge 42 is masked by the gasket 40.

It will also be seen that the curl 50, by projecting both radially outwardly and radially inwardly of the peripheral flange 34, defines a curved surface for engagement with the lug means 30 so as to minimize the resistance of the closure panel 48 to the rotation of the fitment 20 when the container 10 is being opened.

Figure 4:
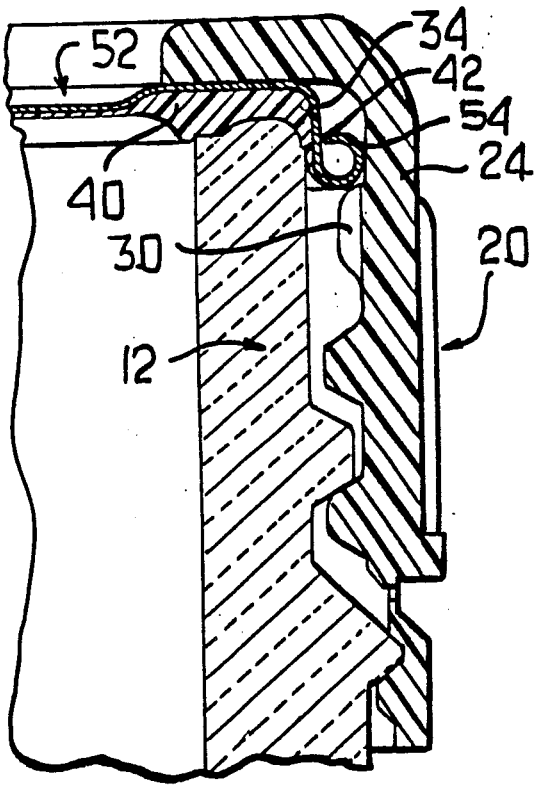
FIG. 4 is another sectional view similar to FIG. 2 and shows another form of the invention.

Reference is now made to FIG. 4 wherein there is illustrated still another form of closure panel, generally identified by the numeral 52. The closure panel 52 differs from the closure panel 22 in that the annular flange 36 thereof is even more foreshortened than in the case of the closure panel 48 whereby the peripheral flange is somewhat remote from the interior surface of the body 24 while being closely adjacent the exterior of the upper part of the neck finish 12. Once again, instead of the peripheral flange 34 terminating directly in the raw edge 42, the peripheral flange terminates in a curl 54. The curl 54 is disposed entirely radially outwardly of the peripheral flange 34 and first goes downwardly, then outwardly and upwardly terminating in the raw edge 42 adjacent the peripheral flange 34 where the curl 54 begins.

In this arrangement, although the raw edge 42 is not masked by any gasket 40, it will be seen that the curl 54, in conjunction with the fitment body 24, serves to isolate the raw edge 42 and generally protect it against corrosive materials. In any event, the raw edge 42 is hidden by the curl 54 and should certain rusting occur, it will not be apparent to a consumer. Furthermore, since the closure panel 52 may be utilized for reclosing purposes, it will be seen that any corrosion of the raw edge 42 can in no way become associated with the product.

It is to be noted that the curl 54, by being disposed radially outwardly of and axially below the peripheral flange 34, will engage the lug means 30 and by presenting a curved surface will facilitate the rotation of the fitment 20 relative to the closure panel 22.

Although the curls 50 and 54 have been illustrated as being circular in cross section, it is to be understood that the cross section of the curls may be modified as so desired in accordance with a desired association with the fitment and the available space between the container and the fitment.

It will also be seen that by moving the peripheral flange 34 radially inwardly, there will be a certain saving of metal so that the additional metal required to form the curls 50, 54 will be minimized. At the same time, there will be a certain savings of the material from which the gaskets 40 are formed. Thus the cost of providing the curls 50, 54 will be less than that of coating the raw edge 42 of the closure panel 22 or forming the closure panel 22 of non-corrosive metal, such as aluminum.

In addition, the other advantages of the curls 50, 54 outweigh the additional cost thereof.

Although only two preferred embodiments of the invention have been specifically illustrated and described herein, it is to be understood that minor variations may be made in the closure panels without departing from the spirit and scope of the invention as defined by the appended claims.

I claim:

1. An end panel for use in combination with a plastic fitment to form a composite closure, said end panel being formed of a metal subject to corrosion and having a peripheral cut raw edge, said end panel being improved by said peripheral edge terminating in a curl of which said cut raw edge is a terminal part and wherein said cut raw edge is at least in part masked by adjacent portions of said curl.

2. An end panel according to claim 1 wherein said end panel includes a depending peripheral wall, and said curl being carried by said peripheral wall.

3. An end panel according to claim 2 wherein said curl projects radially outwardly of said peripheral wall.

4. An end panel according to claim 2 wherein said curl projects radially outwardly of said peripheral wall, and said raw edge is disposed radially outwardly of said peripheral flange.

5. An end panel according to claim 2 wherein said curl projects radially outwardly of said peripheral wall, and said raw edge is disposed radially inwardly of said peripheral flange.

6. An end panel according to claim 2 wherein said curl is generally centered relative to said peripheral wall.

7. An end panel according to claim 2 wherein said curl is generally centered relative to said peripheral wall, and said raw edge is disposed radially inwardly of said peripheral flange.

8. An end panel according to claim 6 wherein on an undersurface thereof there is an annular pocket for a gasket, said pocket being in part defined by a radially inner portion of said curl with said curl forming means for facilitating application of a gasket by spin lining.

9. An end panel according to claim 3 in combination with a plastic fitment, said curl forming a bearing surface engaging said fitment for facilitating relative rotary movement between said fitment and said end panel.

10. A combination in accordance with claim 9 wherein said fitment has lug means engaging said curl for limiting upward axial movement of said fitment relative to said end panel.

* * * * *